US009320583B2

(12) United States Patent
Jeffrey et al.

(10) Patent No.: US 9,320,583 B2
(45) Date of Patent: Apr. 26, 2016

(54) BURR WITH FLOATING GUARD

(71) Applicants: Louis Dale Jeffrey, King Hill, ID (US); Patrick Benhower, Angola, IN (US)

(72) Inventors: Louis Dale Jeffrey, King Hill, ID (US); Patrick Benhower, Angola, IN (US)

( * ) Notice: Subject to any disclaimer, the term of this patent is extended or adjusted under 35 U.S.C. 154(b) by 19 days.

(21) Appl. No.: 13/677,012

(22) Filed: Nov. 14, 2012

(65) Prior Publication Data

US 2014/0134560 A1 May 15, 2014

(51) Int. Cl.
*A61D 5/00* (2006.01)

(52) U.S. Cl.
CPC ..... *A61D 5/00* (2013.01); *Y10T 29/49826* (2015.01); *Y10T 29/49888* (2015.01)

(58) Field of Classification Search
CPC ..... B24B 23/02; B24B 55/00; B24B 55/04–55/057; A61C 1/18; A61C 1/16; A61C 1/05; A61C 1/181; A61C 1/12; A61C 1/082; A61C 1/141; A61C 1/14; A61C 1/10; A61C 17/005; A61C 17/0202; A61C 3/02; A61D 5/00; Y10T 29/49826; Y10T 29/49888
USPC ..... 433/1, 105, 112, 116, 125, 126, 130, 433/134, 32, 165, 166; 606/80; 408/199–233; 279/76
See application file for complete search history.

(56) References Cited

U.S. PATENT DOCUMENTS

| | | | | |
|---|---|---|---|---|
| 3,596,411 | A * | 8/1971 | Hutchins | B24B 23/02 451/358 |
| 5,100,322 | A * | 3/1992 | Weissman | A61C 8/0089 433/165 |
| 5,138,797 | A * | 8/1992 | Siden | B24B 3/33 451/241 |
| 7,029,274 | B1 * | 4/2006 | Capps | A61D 5/00 433/1 |
| 7,238,021 | B1 * | 7/2007 | Johnson | A61C 1/16 433/1 |
| 2003/0228552 | A1 * | 12/2003 | Dipietro | A61D 5/00 433/1 |
| 2004/0166455 | A1 * | 8/2004 | Furney | A61D 5/00 433/1 |
| 2010/0035528 | A1 * | 2/2010 | Eyler | B24B 23/02 451/358 |

* cited by examiner

*Primary Examiner* — Matthew Nelson
(74) *Attorney, Agent, or Firm* — Parsons Behle & Latimer

(57) ABSTRACT

Accordingly, embodiments of the presently described system and method include an equine dentistry burr with a head having a first end and a second end. Some embodiments also include a shank fixably connected to the first end of the head, and wherein the shank is configured to connect the equine dentistry burr to a handpiece assembly. Further embodiments also include a floating guard coupled to at least one of the cylindrical head and the shank, and configured to rotate independently of the cylindrical head and the shank.

12 Claims, 3 Drawing Sheets

BURR WITH FLOATING GUARD

BACKGROUND

A variety of tool bits, often referred to as burrs, are often used for a plurality of tasks including cutting, grinding, smoothing, grating, and abrading, among other things. Burrs may come in any number of sizes and configurations and are often found used, for example, in conjunction with die grinders, rotary tools, and dentistry drills. Often, burrs have cutting surfaces designed to cut or grind in a predetermined fashion. Burrs typically have optimal operating conditions, such as, for example, preferred rotational speeds that might vary based on the size, weight, shape, and materials thereof. For instance, as burrs increase in size, it may be desirable to rotate at higher rotational speeds than smaller-sized burrs. However, burrs that operate at higher rotational speeds can be challenging to wield.

The field of dentistry has adapted burrs for the particular needs of the industry. Indeed, evidence suggesting the use of primitive drills in early dentistry dates as far back as 7000 B.C. Modern dentistry relies heavily on high speed drills with specially-adapted burrs. For instance, a high speed dental drill with an appropriate burr may be used in such common procedures as removal of tooth decay and shaping tooth structure prior to insertion of a filling or a crown, among other things. In fact, dental drills tend to be so precise that they are often used by jewelers and hobbyists.

One category of dentistry that relies upon drills and burrs is equine dentistry. Equine dentistry presents significant challenges, including but not limited to those posed by the size of horse teeth. For instance, the size of horse teeth necessitates the use of burrs that are larger than those used in traditional dentistry. However, larger burrs may increase the risk of unintentional contact with unintended surfaces, such as soft tissue like cheeks and gums. Larger burrs may also be more difficult to control than traditional dental burrs.

Furthermore, in the field of equine gnathology, and the morphology of equine teeth, it is often necessary to sculpt teeth during prophylactic and equilibration procedures and this may require extensive use of grinding tools. As noted, burr contact with the soft tissues of the animal may cause discomfort and difficulty with the procedures, particularly where extensive sculpting is necessary. Likewise, because of existing designs and sizes most burrs are difficult to introduce into an equine dental arcade battery to address any anomalies present there. In addition, existing burr designs are often difficult to control when sculpting equine teeth to correct dental table angles, arcade steps, transverse ridging, and the like. Additionally, given the typical length of the handpiece, and the large size of the dental arcade, it is often difficult to exert sufficient pressure on, or to exercise sufficient control over, the grinding head of an equine dental tool. Other drawbacks and limitations with existing burrs also exist.

SUMMARY

Accordingly, one advantage of the presently disclosed burr is that it addresses the drawbacks and limitations of existing devices.

In addition, there is a need for a burr that may be any number of sizes, materials, and shapes without sacrificing ease of control. A burr that may be operated and controlled in constrained spaces is also desired. Furthermore, there is a need for a burr that reduces contact with unintended surfaces. Accordingly, embodiments of the presently described system and method comprise an equine dentistry burr comprising a head comprising a first end and a second end. Some embodiments also comprise a shank fixably connected to the first end of the head, and wherein the shank is configured to connect the equine dentistry burr to a handpiece assembly. Further embodiments also include a floating guard coupled to at least one of the cylindrical head and the shank, and configured to rotate independently of the cylindrical head and the shank.

Other advantages and features of the presently disclosed system and method will be apparent to those of skill in the art.

BRIEF DESCRIPTION OF THE DRAWINGS

Like reference numbers and designations in the various drawings indicate like elements.

DETAILED DESCRIPTION

In the following detailed description, reference is made to the accompanying drawings that form a part hereof, and in which is shown by way of illustration specific embodiments in which the invention may be practiced. These embodiments are described in sufficient detail to enable those skilled in the art to practice the invention, and it is to be understood that other embodiments may be utilized and that various changes may be made without departing from the spirit and scope of the present invention. The following detailed description is, therefore, not to be taken in a limiting sense.

Figure 1:
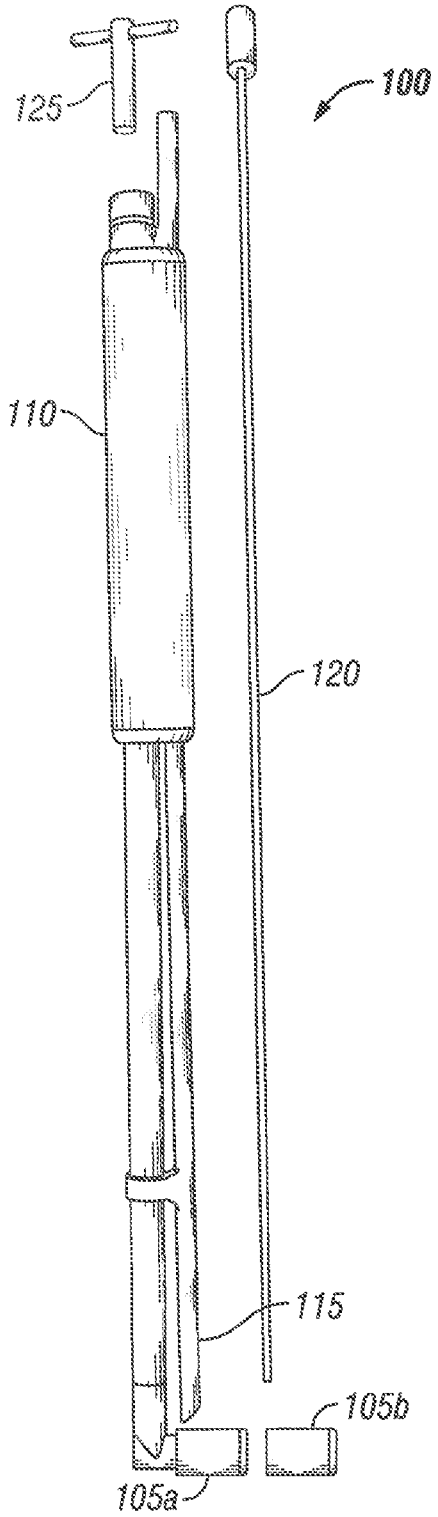
FIG. 1 is a perspective view of one embodiment of a burr and handpiece assembly.

FIG. 1 is a perspective view of a grinder assembly 100. As used herein, grinding (as well as its other forms and verb tenses) also encompasses cutting, buffing, filing, grating, polishing, rubbing, sanding, scraping, smoothing, whetting, and abrading, among other things. According to one embodiment, a handpiece assembly 110 is coupled to a burr 105*a* (or 105*b*), and a vacuum pipe 115. The burr 105*a* may be arranged substantially transversal to the handpiece assembly 110 and arranged in proximity to the vacuum pipe 115 so as to facilitate of dust and debris. The grinder assembly 100 may be configured to accept any possible number of burrs 105*a* and 105*b*, such as, for instance, diamond-coated burrs and carbide burrs. However, burrs comprising any number of materials are contemplated by the present disclosure.

In operation, a drive line (not shown) within the handpiece assembly 110 may operate to rotate the burr 105*a* around a central axis. As the rotating burr 105*a* comes into contact with a selected material, the burr 105*a* may grind the selected material. Vacuum pipe 115 may be connected to a vacuum, or blower, system (not shown) configured to extract dust and debris removed from the selected material and that may be found in the area in which the grinder assembly 100 is used. In one embodiment, as the burr 105*a* rotates at a high speed, it may remove material from an intended surface, such as a stone, a piece of wood, or a tooth, among other things. Of course, any number of possible operational embodiments is contemplated by the current disclosure.

FIG. 1 also shows an example of a key 125 for holding the drive system of handpiece assembly 110 in place when installing or removing a burr 105*a*, 105*b*. Of course, the type of key 125 will vary with the handpiece 110 drive system and, instead of being a separate piece as shown, may also be integral with the handpiece 110. In addition, some embodiments may also include a cleaning rod 120 for vacuum pipe 115. Likewise, other configurations and mechanisms for cleaning the vacuum pipe 115 may also be implemented.

Figure 2:
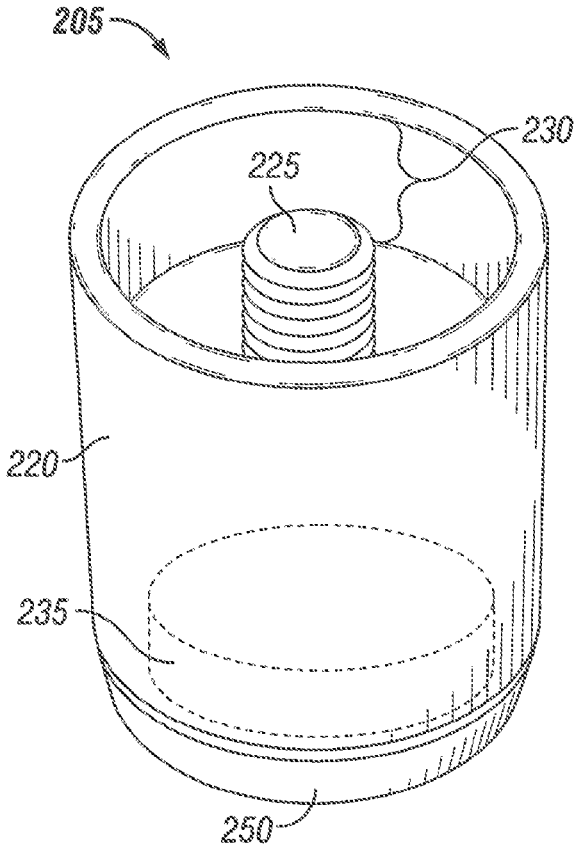
FIG. 2 is a perspective view of one embodiment of a burr also showing an internal bearing with a broken line.

FIG. 2 shows a burr 205 comprising a connecting member 225 (often, a shank) an external surface 220 and a floating guard 250. In one embodiment, the floating guard 250 is connected to the burr 205 via a bearing 235. As used herein, a bearing may comprise a plain bearing or a rolling bearing, among other things. More generally, a bearing may be any part that constrains the relative motion of two or more parts of the burr 205. Therefore, floating guard 250 may be any type of guard configured to rotate independently of the external surface 220 of the burr 205. In one embodiment, the burr 205 may comprise a recess 230 that offers a reduced profile and may permit parts of the drive unit of the handpiece assembly 110 to be positioned within the burr 205. The recess 230 may also facilitate the inclusion of bearings (e.g., 235) within burr 205. In addition, recess 230 facilitates a tool head with a reduced overall lateral width, but also one that still has a grinding surface of sufficient size. Furthermore, recess 230 allows for a burr with reduced mass that, among other things, reduces wear-and-tear on the drive head mechanism, allows for quicker rotational response, and reduces the shock load on the drive line. The external surface 220 of the burr 205 may comprise any number of possible materials including, but not limited to, diamond, carbide, and steel.

In operation, the burr 205 may be configured to rotate with a connecting member 225. For instance, the connecting member 225 may be driven by a drive line of a handpiece assembly 110 and may induce motion of an external surface 220 of the burr 205. Connecting member 225 is shown as a threaded connection in FIG. 2, but the disclosed system is not so limited. Any suitable connecting member, such as snaps, sockets, collets, collars, or the like may be implemented to connect burr 205 to the handpiece assembly 110. In one embodiment, as the external surface 220 of the burr 205 may rotate in a given direction and at a given speed, the floating guard 250, which is connected to the burr 205 via a bearing 235, may rotate in a different direction and at a different speed than the external surface 220. Alternatively, the floating guard 250 may rotate in the same direction but at a different speed than the external surface 200. Indeed, floating guard 250 may be stopped altogether by merely putting pressure thereon with, for instance, a finger. This embodiment may offer any number of potential advantages including facilitating maneuverability of the grinder assembly 100 and eliminating detrimental contact with unintended surfaces (e.g., the cheek or tongue of a horse). For instance, rather than potentially damaging an unintended surface with an end of the burr 205 that rotates at the same rotational speed as the external surface 220 of the burr 205, floating guard 250 may be configured to stop completely when contacting an unintended surface while nevertheless allowing the external surface 220 of the burr 205 to continue rotating unabated. Additionally, floating guard 250 may reduce wear on the drive mechanism of a grinder assembly 100 by unintended external forces.

Figure 3:
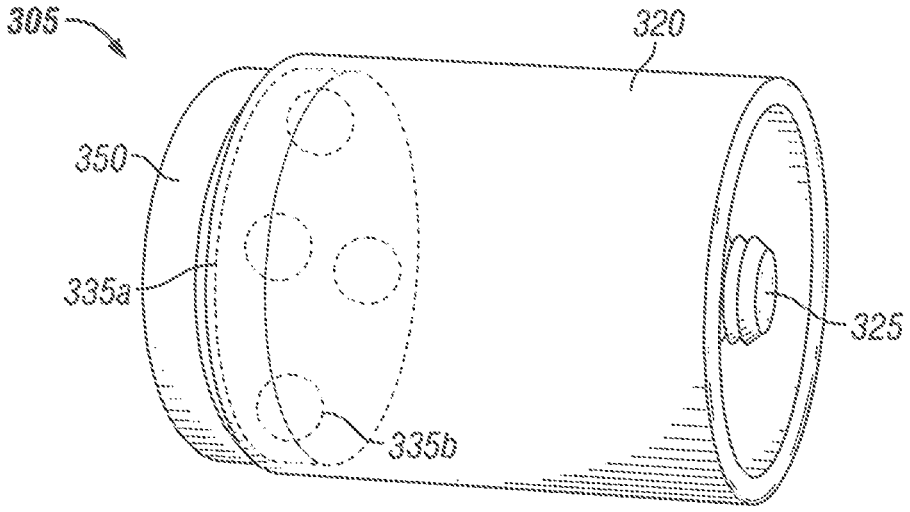
FIG. 3 is a perspective view of another embodiment of a burr.

FIG. 3 demonstrates another embodiment of a burr 305 comprising an external surface 320, a connecting member 325, and a floating guard 350 connected to the burr 305 by way of a bearing comprising a plain bearing component 335*a* and a rolling bearing component 335*b*. As shown by FIG. 3, any number of possible bearings, such as plain bearing 335*a* and rolling bearings 335*b*, are contemplated by the present disclosure.

In one embodiment, when the floating guard 350 comes in contact with any stationary surface, its natural rotation may be stopped in order to prevent burning or abrasion to the contacted surface. In this embodiment, considerable pressure may be placed against the floating guard 350 without harming the burr 305 or the drive system of the grinder assembly 100.

Figure 4:
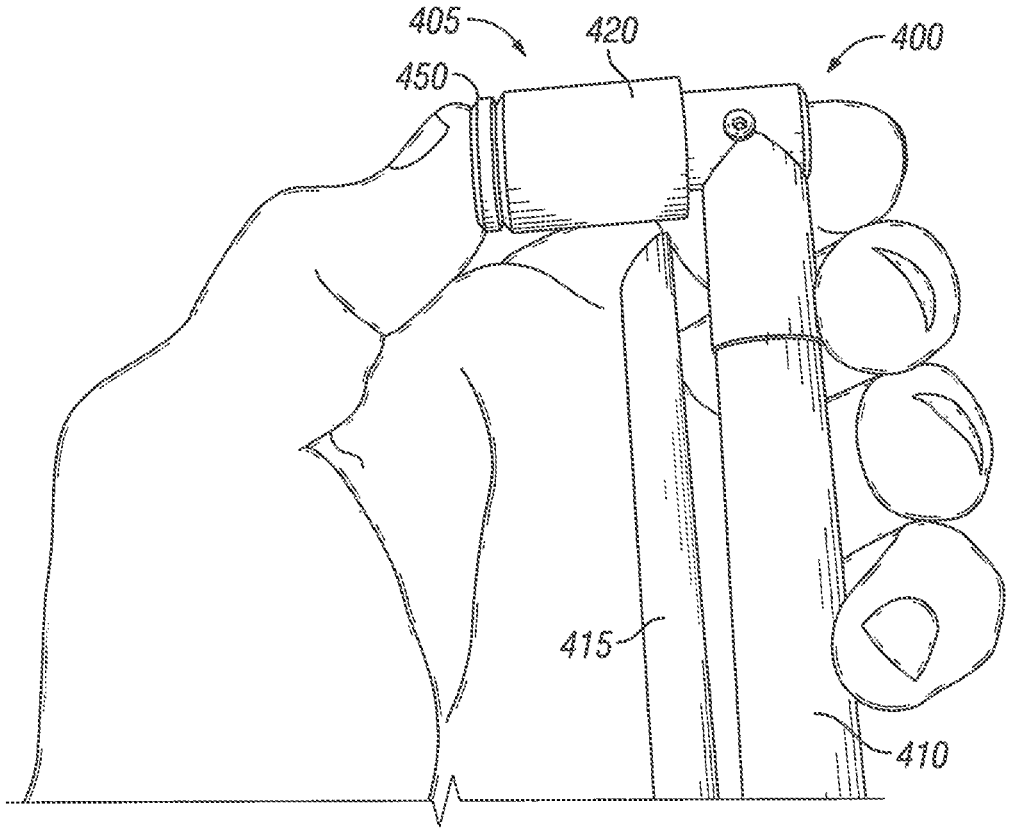
FIG. 4 demonstrates one method of holding a burr and handpiece assembly according to the current disclosure.

FIG. 4 demonstrates one embodiment of a grinder assembly 400 as held by a user. Grinder assembly 400 comprises a burr 405 coupled to a handpiece assembly 410 and a vacuum pipe 415 arranged in proximity thereto. Burr 405 also comprises a floating guard 450 and an external surface 420.

As will be readily understood by one of ordinary skill in the art, the burr 405 comprising the floating guard 450 may promote greater control of the burr 405 and may eliminate unintended contact between the external surface 420 of the burr 405 and the area where the grinder assembly 400 is being used (e.g., soft tissue burning). For instance, in one embodiment, holding the grinder assembly 400 between fingers, such that one finger rests on the floating guard 450 and a different finger rests upon the back of the handpiece assembly 410 may allow the user to better control the head of the burr 405, and therefore, the external surface 420 of the burr 405. For instance, gripping both the handpiece assembly 410 and the floating guard 450 may allow a user to brace against recoil caused when the external surface 420 of the burr 405 comes in contact with a material. Such a grip may also permit a user to more readily operate a grinder assembly 400 in a tight space, such as a horse's mouth. Additionally, floating guard 450 may also reduce contact with unintended surfaces, such as, for instance, the tongue or cheek of a patient. Furthermore, embodiments of the grinder assembly 400 may be used for all types of grinding and removal of almost any type of material.

Figure 5:
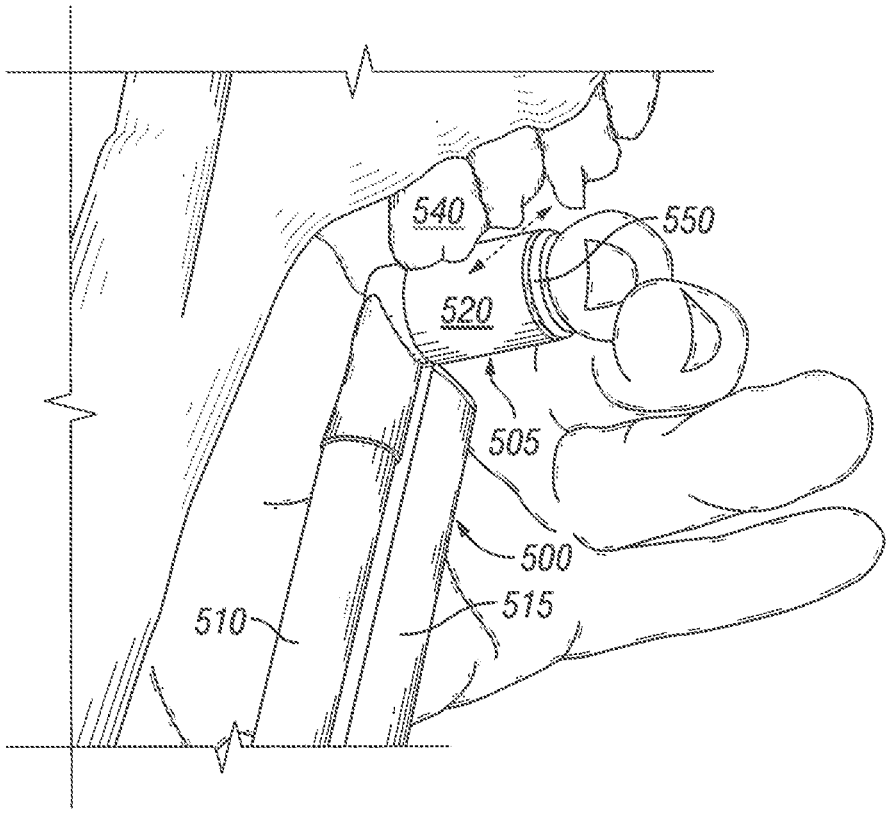
FIG. 5 illustrates a method of use of a burr and handpiece assembly according to the current disclosure.

FIG. 5 illustrates one possible embodiment of the grinder assembly 500. In this embodiment, the grinder assembly 500 comprises a burr 505 connected transversally to a handpiece assembly 510 and in relation to a vacuum pipe 515. As discussed above, the grinder assembly 500 may be gripped on the handpiece assembly 510 and floating guard 550 of the burr 505. The external surface 520 of the burr 505 may be placed in contact with a given material, such as, for instance, an equine tooth 540.

In operation, the burr 505 may be used to cut an equine tooth 540 in anterior, caudal, posterial, and rostral directions (as shown by the arrows in FIG. 5). A burr 505 with a recess 230 (see FIG. 2) may also have a smaller profile thus facilitating access to dental arcade battery anomalies. Additional advantages may also include (a) facilitating reduction of protuberant teeth, (b) facilitating correction of cheek teeth battery table angles, (c) facilitating reduction of back ramps with correct table angles, (d) facilitating correction of excessive transverse ridging, (e) facilitating correction of arcade steps, and (f) facilitating addressing front hooks on the first cheek teeth (and installing bit seats), among other things.

Figure 6:
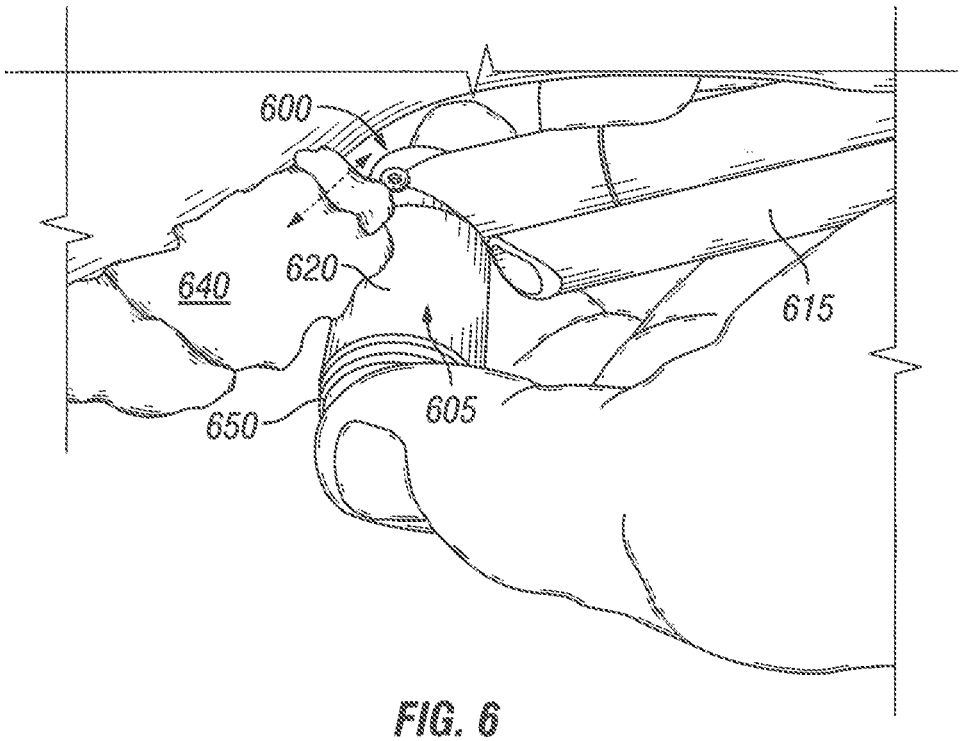
FIG. 6 illustrates another method of use of a burr and handpiece assembly.

FIG. 6 illustrates another embodiment of the grinder assembly 600 comprising a vacuum pipe 615 in proximity to the external surface 620 of the burr 605 and a floating guard 650. FIG. 6 demonstrates the use of the grinder assembly 600 with an equine tooth 640. Of course, the grinder may be applied in a number of environments, and upon any number of suitable materials. For instance, burr 605 may be a variety of styles and sizes in order to facilitate the grinding of a variety of different materials such as wood, stone, bone, tooth enamel, metal, plastics, composite materials, and the like.

Likewise, while a generally cylindrical burr 605 is depicted, the invention is not so limited. Any suitable profile, shape, or contour may be provided to facilitate the desired result or particular application contemplated.

Although this invention has been described in terms of certain preferred embodiments, other embodiments that are apparent to those of ordinary skill in the art, including embodiments that do not provide all of the features and advantages set forth herein, are also within the scope of this invention. Accordingly, the scope of the present invention is defined only by reference to the appended claims and equivalents thereof.

What is claimed is:

1. An equine dentistry burr comprising:

a generally cylindrical body comprising a first end and a second end and an outer circumference;

a first recess within an interior of the first end of the generally cylindrical body;

a shank fixably connected to the first end of the generally cylindrical body, and wherein a first portion of the shank is contained within the first recess, and wherein the shank is configured to connect the equine dentistry burr to a handpiece assembly;

a second recess within an interior of the second end of the generally cylindrical body;

at least a portion of a bearing within the second recess; and a floating guard sized to not extend beyond the outer circumference of the generally cylindrical body and coupled to the at least a portion of a bearing and configured to rotate independently of the generally cylindrical body and the shank, and further configured to stop from rotating when pressure is applied to the floating guard.

2. The burr of claim 1 wherein the generally cylindrical body further comprises an external surface configured for grinding.

3. The burr of claim 2 further wherein the external surface comprises diamond.

4. The burr of claim 1 wherein the at least a portion of a bearing is coupled to a remaining portion of a bearing connected between the floating guard and the generally cylindrical body.

5. The burr of claim 4 wherein the bearing is a plain bearing.

6. The burr of claim 1 wherein the application of pressure to the floating guard causes the rotation of the floating guard to be arrested without arresting the rotation of the generally cylindrical body.

7. A burr configured to cut or grind and attachable to a handpiece assembly, the burr comprising a generally cylindrical body comprising a first end and a second end and an outer circumference, and further comprising:

a first recess within an interior of the first end;

a connecting member fixably connected to the first end wherein at least a portion of the connecting member is within the first recess, and wherein the connecting member is configured to connect the burr to a handpiece assembly;

a second recess within an interior of the second end;

at least a portion of a bearing within the second recess; and a floating guard sized to not extend beyond the outer circumference of the generally cylindrical body and coupled to the at least a portion of a bearing at the second end, wherein the floating guard is configured to move independently of the burr and the connecting member.

8. The burr of claim 7 further configured to connect transversally to the handpiece assembly such that a vacuum pipe on the handpiece assembly is arranged in proximity to and transversal to the burr.

9. The burr of claim 7 wherein the at least a portion of a bearing is coupled to a remaining portion of a bearing, and wherein the bearing is coupled between the floating guard and the second end.

10. The burr of claim 9 wherein the bearing is a plain bearing.

11. The burr of claim 7 wherein the burr is cylindrical and comprises an exterior surface.

12. The burr of claim 11 wherein the exterior surface comprises at least one of diamond and carbide.

* * * * *